US005153169A

United States Patent [19]

Freedman et al.

[11] Patent Number: 5,153,169

[45] Date of Patent: Oct. 6, 1992

[54] IMAGING MEDIA CONTAINING HINDERED AMINE LIGHT STABILIZERS OR NITRONES

[75] Inventors: James R. Freedman, Newton Centre; Michael A. Young, Natick, both of Mass.

[73] Assignee: Polaroid Corporation, Cambridge, Mass.

[21] Appl. No.: 695,932

[22] Filed: May 6, 1991

[51] Int. Cl.[5] ..... B41M 5/30

[52] U.S. Cl. ..... 503/209; 503/216; 503/217; 503/218; 503/224

[58] Field of Search ..... 503/208, 209, 218, 224, 503/226, 216, 217

[56] References Cited

U.S. PATENT DOCUMENTS

| | | | |
|---|---|---|---|
| 4,602,263 | 7/1986 | Borrer et al. | 346/201 |
| 4,720,449 | 1/1988 | Borrer et al. | 430/338 |
| 4,720,450 | 1/1988 | Ellis | 430/339 |
| 4,745,046 | 5/1988 | Borrer et al. | 430/332 |
| 4,826,976 | 5/1989 | Borrer et al. | 544/58.4 |
| 4,861,748 | 8/1989 | Saeki et al. | 503/208 |
| 4,960,901 | 10/1990 | Borrer et al. | 548/207 |

OTHER PUBLICATIONS

Padron, A. J. C., Rev. Macromol. Chem. Phys. 30(1), 107-154 (1990).

*Primary Examiner*—Pamela R. Schwartz
*Attorney, Agent, or Firm*—David J. Cole

[57] ABSTRACT

An imaging medium has at least one color-forming layer comprising a thermal color-forming composition adapted to undergo a change of color upon increase in the temperature of the color-forming layer above a color-forming temperature for a color-forming time, the color-forming layer further comprising a color stabilizer which is a hindered amine light stabilizer or a nitrones. The color stabilizer prevents development of color in the medium during storage before or after imaging, thereby reducing the minimum optical density of the imaged medium and/or color distortion in the image.

19 Claims, 1 Drawing Sheet

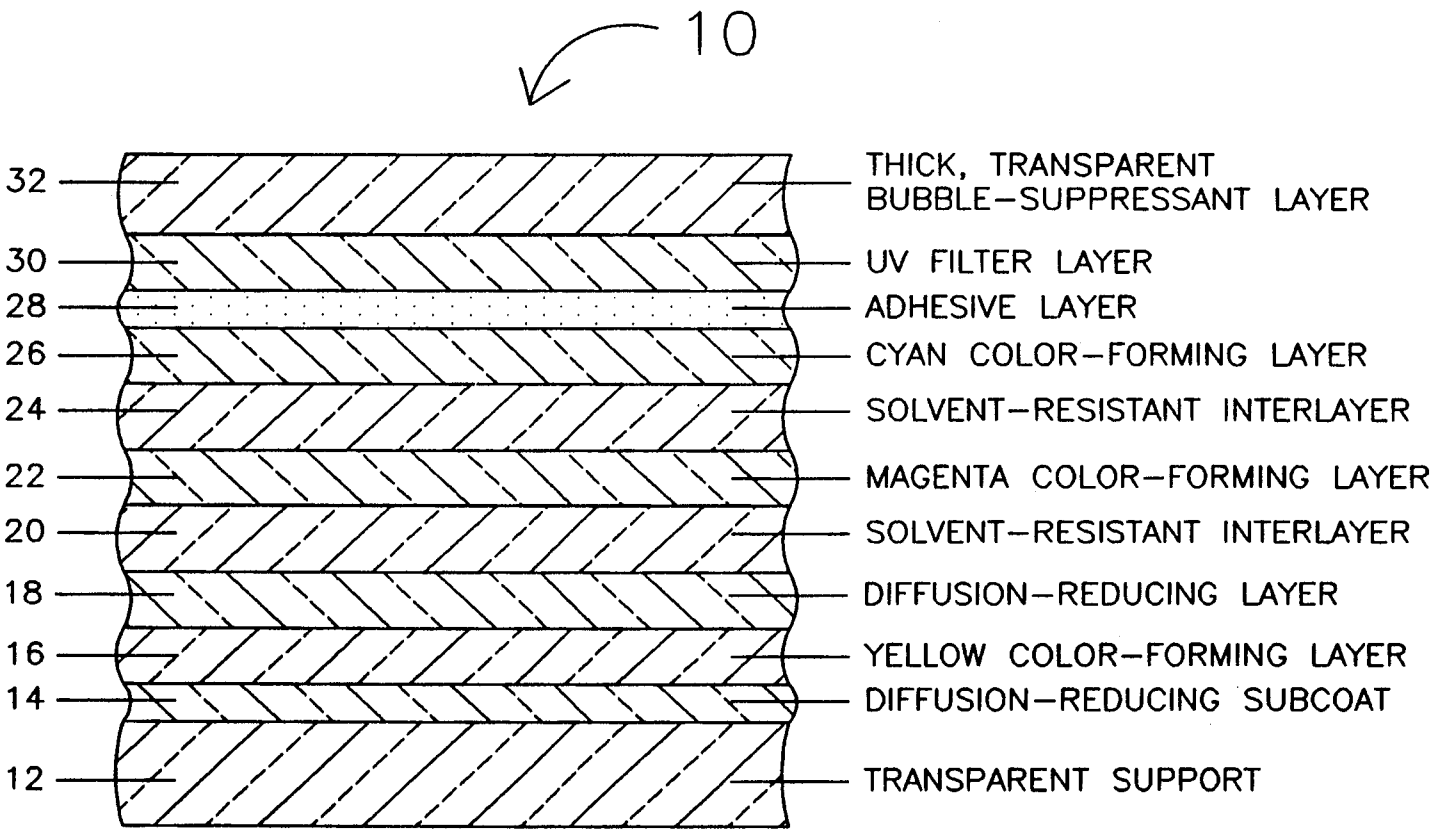
10
32
THICK, TRANSPARENT BUBBLE-SUPPRESSANT LAYER
30
UV FILTER LAYER
28
ADHESIVE LAYER
26
CYAN COLOR-FORMING LAYER
24
SOLVENT-RESISTANT INTERLAYER
22
MAGENTA COLOR-FORMING LAYER
20
SOLVENT-RESISTANT INTERLAYER
18
DIFFUSION-REDUCING LAYER
16
YELLOW COLOR-FORMING LAYER
14
DIFFUSION-REDUCING SUBCOAT
12
TRANSPARENT SUPPORT

IMAGING MEDIA CONTAINING HINDERED AMINE LIGHT STABILIZERS OR NITRONES

REFERENCES TO RELATED APPLICATIONS

The copending application Ser. No. 07/695,641, filed May 6, 1991, by Edward P. Lindholm et al. and assigned to and same assignee as the present application, describes and claims thermal imaging media having the topcoat shown in the accompanying drawing.

The copending application Ser. No. 07/696,196, filed May 6, 1991, by Edward P. Lindholm et al. and assigned to the same assignee as the present application, describes and claims thermal imaging media having a color-forming layer with a high glass transition temperature, and at least one diffusion-reducing layer, as shown in the accompanying drawing.

The copending application Serial No. 07/696,222, filed May 6, 1991, by Donald A. McGowan et al. and assigned to the same assignee as the present application, describes and claims the infra-red dye of formula:

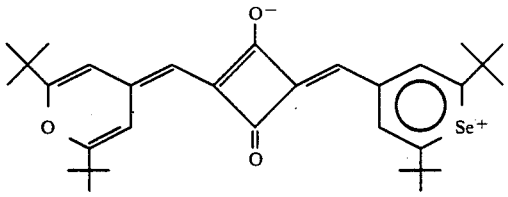

used in the thermal imaging medium of the present invention shown in the accompanying drawing.

Copending application Ser. No. 07/696,151, filed May 6, 1991, by Roger A. Boggs et al., and assigned to the same assignee as the present application, describes and claims leuco dyes which can be used in the thermal imaging medium of the present invention.

Copending application Ser. No. 07/277,014, filed Nov. 28, 1988 by Roger A. Boggs et al., and assigned to the same assignee as the present application, describes and claims the yellow leuco dye used in the thermal imaging medium of the present invention shown in the accompanying drawing.

Copending application Ser. No. 07/548,223, filed Jun. 29, 1990 by Lloyd D. Taylor et al., and assigned to the same assignee as the present application, describes and claims quinophthalone leuco dyes which can be used in the thermal imaging medium of the present invention.

The disclosures of all the aforementioned patents and copending applications are herein incorporated by reference.

BACKGROUND OF THE INVENTION

This invention relates to a imaging medium having a color-forming layer containing a color stabilizer, and to a process for forming an image using such an imaging medium.

Imaging media are known which have at least one color-forming layer comprising a color-forming composition adapted to undergo a rapid change of color (from colorless to colored, from colored to colorless, or from one color to another) upon increase in the temperature of the color-forming layer above a color-forming temperature for a color-forming time. The color change in such media need not be supplied by applying heat directly to the medium; the color-forming composition may comprise a color-forming compound which undergoes a change of color upon heating above a color-forming temperature, and an absorber capable of absorbing actinic radiation and thereby generating heat in the color-forming layer. When such a medium is exposed to appropriate actinic radiation, this radiation is absorbed by the absorber, thereby heating the color-forming compound and causing it to undergo its color change. Many such thermal imaging media have the advantage over conventional silver halide media of not requiring a post-exposure developing step. Such thermal imaging media also have the advantage that they are essentially insensitive to visible light, so that they can be handled under normal lighting conditions.

For example U.S. Pat. Nos. 4,602,263 and 4,826,976 both describe thermal imaging systems for optical recording and particularly for forming color images. These thermal imaging systems rely upon the irreversible unimolecular fragmentation of one or more thermally unstable carbamate moieties of an organic compound to effect a visually discernible color shift. U.S. Pat. No. 4,720,449 describes a similar imaging system in which the color-developing component is a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to the meso carbon atom and the nitrogen atom being bound to a group with a masked acyl substituent that undergoes fragmentation upon heating to liberate the acyl group for effecting intramolecular acylation of the nitrogen atom to form a new group in the ortho position that cannot bond to the meso carbon atom, whereby the di- or triarylmethane compound is rendered colored. Other thermal imaging systems using di- or triarylmethane compounds are described in U.S. Pat. Nos. 4,720,450 and 4,960,901, while U.S. Pat. No. 4,745,046 describes a thermal imaging system using as color-forming co-reactants a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting the di- or triarylmethane compound undergoes a bimolecular nucleophilic substitution reaction with the nucleophilic moiety to form a colored, ring-opened di- or triarylmethane compound. Finally, the aforementioned application Ser. No. 07/277,014, now abandoned, describes a thermal imaging system in which the color-forming component is a colorless precursor of a preformed image dye substituted with (a) at least one thermally removable protecting group that undergoes fragmentation from the precursor upon heating and (b) at least one leaving group that is irreversibly eliminated from the precursor upon heating, provided that neither the protecting group nor the leaving group is hydrogen, said protecting and leaving groups maintaining the precursor in its colorless form until heat is applied to effect removal of the protecting and leaving groups, whereby the colorless precursor is converted to an image dye.

The aforementioned patents describe a preferred form of thermal imaging medium for forming multicolor images; in this preferred imaging medium, three separate color-forming layers, capable of forming yellow, cyan and magenta dyes respectively, are superposed on top of one another. Each of the three color-forming layers has an infra-red absorber associated therewith, these absorbers absorbing at differing wavelengths, for example 760, 820 and 880 nm. This medium is imagewise exposed simultaneously to three lasers having wavelengths of 760, 820 and 880 nm. (In the present state of technology, solid state diode lasers emitting at about 760 to 1000 nm provide the highest output per unit cost. Since most of the color-forming materials (also hereinafter referred to as "leuco dyes", with the understanding that the leuco dye may comprise more than one compound) described in the aforementioned patents do not have high extinction coefficients within this wavelength range, it is necessary to include the infra-red absorbers with the leuco dyes in order to ensure efficient absorption of the laser radiation and hence efficient heating of the leuco dye.) The resultant imagewise heating of the color-forming layers causes the leuco dyes to undergo color changes in the exposed areas, thereby producing a multicolored image, which needs no development. This preferred type of imaging medium is capable of very high resolution images; for example, the medium can readily be imaged using a laser to produce a 2000 line 35 mm slide.

Some of the leuco dyes described in the aforementioned patents and copending applications have been found to be sensitive to ultraviolet radiation; if an imaging medium containing such an ultra-violet sensitive leuco dye is exposed to ultra-violet radiation prior to imaging, some color develops in the medium due to chemical changes in the leuco dye. This color development increases the minimum optical density ($D_{min}$) of the medium and if sufficiently severe may cause color distortion in the image. Similar undesirable development of color may occur if an imaged medium is exposed to ultra-violet light after imaging, since the imaged medium still contains substantial amounts of the leuco dye. This undesirable development of color can be greatly reduced by providing an ultra-violet absorber layer in the imaging medium so as to prevent most ultra-violet radiation reaching the color-forming layer(s) of the medium.

However, it has now been found that, at least with some leuco dyes, even the provision of an ultra-violet absorber layer does not entirely overcome the problem of unwanted color development in the imaging medium before or after imaging, since even media containing such an ultra-violet absorber layer display unwanted color development when exposed to ambient light (even indoors) for extended periods of time. Hence, there is a need for additional techniques for preventing such unwanted color development, and this invention provides such a technique.

SUMMARY OF THE INVENTION

Accordingly, this invention provides an imaging medium having at least one color-forming layer comprising a thermal color-forming composition adapted to undergo a change of color upon increase in the temperature of the color-forming layer above a color-forming temperature for a color-forming time, the color-forming layer further comprising a color stabilizer selected from the group consisting of hindered amine light stabilizers and nitrones.

This invention also provides a process for forming an image, the process comprising:

providing an imaging medium comprising a color-forming layer comprising a thermal color-forming composition adapted to undergo a change of color upon increase in the temperature of the color-forming layer above a color-forming temperature for a color-forming time, the color-forming layer further comprising a color stabilizer selected from the group consising of hindered amine light stabilizers and nitrones;

imagewise heating the color-forming layer above the color-forming temperature for the color-forming time, thereby causing the color-forming composition to undergo the change of color in heated regions and thereby form an image.

BRIEF DESCRIPTION OF THE DRAWING

The accompanying drawing shows a schematic cross-section through a preferred imaging medium of the present invention.

DETAILED DESCRIPTION OF THE INVENTION

As already mentioned, the imaging medium of the present invention comprises at least one color-forming layer, this layer comprising a thermal color-forming composition adapted to undergo a change of color upon increase in the temperature of the color-forming layer above a color-forming temperature for a color-forming time. At least one color-forming layer of the medium contains a color stabilizer, this stabilizer being a hindered amine light stabilizer or a nitrone. The presence of the hindered amine light stabilizer or nitrone reduces or eliminates the photoinstability of the imaging medium, that is to say the tendency for the medium, without heating, to develop color when it is exposed to ambient light.

It should be noted that, at least in the one case which has been investigated to date, the colored breakdown products of the leuco dye which are responsible for the unwanted color development (hereinafter referred to as "photocoloration") are not the same as the colored thermal breakdown product of the same leuco dye produced during imaging of the medium. Although the exact nature of the breakdown products resulting from photoinstability has not been established, spectroscopic examination of media in which photocoloration has occurred show no significant amount of the colored thermal breakdown product of the leuco dye to be present. It is uncertain exactly what (if any) environmental factors other than light are responsible for the photocoloration problem.

The color stabilizer used in the imaging medium and process of the present invention is preferably a hindered amine light stabilizer. Hindered amine light stabilizers are of course well-known compounds and are available commercially. However, these stabilizers are typically used to prevent photolytic decomposition of polymers and have not hitherto (so far as the present inventors are aware) been used to stabilize leuco dyes.

The hindered amine light stabilizer used in present imaging medium desirably has a molecular weight of at least about 500; low molecular weight hindered amine light stabilizers show a tendency to diffuse out of the color-forming layer during coating and/or storage of the imaging medium and since it appears that the hindered amine light stabilizer must be present in the color-forming layer to prevent photocoloration thereof, hindered amine light stabilizer that migrates out of the color-forming layer is not effective in preventing photocoloration. However, lower molecular weight hindered amine stabilizers may be useful if immobilized within the desired layer. Preferred hindered amine light stabilizers for use in the present medium are those having 4-[N-methyl-2,2,6,6-tetraalkylpiperidinyl groups and/or 4-[2,2,6,6-tetraalkylpiperidinyl] groups. One specific commerical hindered amine light stabilizer which has been found to give good results in the present medium is that sold under the trademark "MIXXIM HALS 63" by the Phoenix Polymer Additives Division of Fairmount Chemical Co., Inc., 117 Blanchard Street, Newark N.J. 07105. According to the manufacturer, this material has the formula:

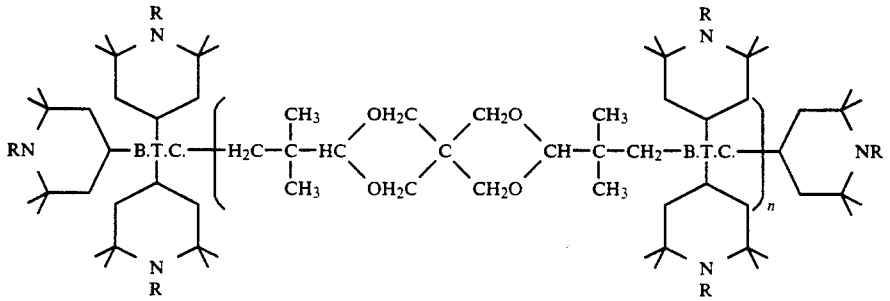

where B.T.C. represents the residue of butanetetracarboxylic acid and R represents a methyl group.

As with the imaging media described in the aforementioned U.S. Patents, in the imaging medium of the present invention the color-forming composition desirably comprises a color-forming compound which undergoes a change of color upon heating above a color-forming temperature, and an absorber capable of absorbing actinic radiation and thereby generating heat in the color-forming layer. This type of imaging medium can be imaged by actinic radiation rather than by direct heating, and a high resolution image is more easily achieved using actinic radiation, for example a focussed laser.

The optimum amount of hindered amine light stabilizer for use in any specific imaging medium of the present invention may readily be determined by routine empirical tests. In general, it has been found desirable to include in the the color-forming layer at least about 0.01, and preferably at least about 0.05, parts by weight of hindered amine light stabilizer per part by weight of the color-forming compound; typically amounts of hindered amine light stabilizer not greater than 0.1 parts by weight per part by weight of the color-forming compound provide sufficent protection against photocoloration. Larger amounts of hindered amine light stabilizer do not appear to provide additional benefits and may have undesirable effects, for example by decreasing the proportion of leuco dye in the color-forming layer, with consequent loss of sensitivity of the imaging medium.

The color-forming composition used in the present imaging medium may be any of those described in the aforementioned patents and copending Applications. Thus, the color-forming composition may be:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, said unimolecular fragmentation visibly changing the appearance of the organic compound (see U.S. Pat. No. 4,602,263);

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to said meso carbon atom and said nitrogen atom being bound to a group with a masked acyl substituent that undergoes fragmentation upon heating to liberate the acyl group for effecting intramolecular acylation of said nitrogen atom to form a new group in the ortho position that cannot bond to the meso carbon atom, whereby said di- or triarylmethane compound is rendered colored (see U.S. Pat. No. 4,720,449);

c. a colored di- or triarylmethane imaging compound possessing within its di- or triarylmethane structure an aryl group substituted in the ortho position to the meso carbon atom with a thermally unstable urea moiety, said urea moiety undergoing a unimolecular fragmentation reaction upon heating to provide a new group in said ortho position that bonds to said meso carbon atom to form a ring having 5 or 6 members, whereby said di- or triarylmethane compound becomes ring-closed and rendered colorless (see U.S. Pat. No. 4,720,450);

d. in combination, a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting said di- or triarylmethane compound undergoes a bimolecular nucleophilic substitution reaction with said nucleophilic moiety to form a colored, ring-opened di- or triarylmethane compound (see U.S. Pat. No. 4,745,046);

e. a compound of the formula $$[M'(-X)_q]_pD$$

wherein M' has the formula:

$$Z'-\underset{\underset{R}{|}}{N}-$$

wherein R is alkyl; $-SO_2R^1$ wherein $R^1$ is alkyl; phenyl; naphthyl; or phenyl substituted with alkyl, alkoxy, halo, trifluoromethyl, cyano, nitro, carboxy, $-CONR^2R^3$ wherein $R^2$ and $R^3$ each are hydrogen or alkyl, $-CO_2R^4$ wherein $R^4$ is alkyl or phenyl, $-COR^5$ wherein $R^5$ is amino, alkyl or phenyl, $-NR^6R^7$ wherein $R^6$ and $R^7$ each are hydrogen or alkyl, $—SO_2NR^8R^9$ wherein $R^8$ and $R^9$ each are hydrogen, alkyl or benzyl; Z' has the formula:

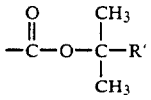

wherein R' is halomethyl or alkyl; X is —N=, $—SO_2—$ or $—CH_2—$; D taken with X and M' represents the radical of a color-shifted organic dye; q is 0 or 1; and p is a whole number of at least 1; said Z' being removed from said M' upon the application of heat to effect a visually discernible change in spectral absorption characteristics of said dye (see U.S. Pat. No. 4,826,976);

f. a substantially colorless di- or triarylmethane compound of the formula:

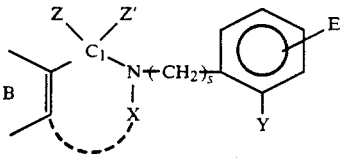

wherein ring B represents a carbocyclic aryl ring or a heterocyclic aryl ring; $C_1$ represents the meso carbon atom of said di- or triarylmethane compound; X represents —C(=O)—; $—SO_2—$ or $—CH_2—$ and completes a moiety ring-closed on said meso carbon atom, said moiety including the nitrogen atom bonded directly to said meso carbon atom; Y represents —NH—C(=O)—L, wherein L is a leaving group that departs upon thermal fragmentation to unmask —N=C=O for effecting intramolecular acylation of said nitrogen atom to open the N-containing ring and form a new group in the ortho position of ring B that cannot bond to said meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when said N-containing ring is open, and Z and Z' taken together represent the bridged moieties to complete the auxochromic system of a bridged triarylmethane dye when said N-containing ring is open (see U.S. Pat. No. 4,960,901);

g. a colorless precursor of a preformed image dye substituted with (a) at least one thermally removable protecting group that undergoes fragmentation from said precursor upon heating and (b) at least one leaving group that is irreversibly eliminated from said precursor upon heating, provided that neither said protecting group nor said leaving group is hydrogen, said protecting and leaving groups maintaining said precursor in its colorless form until heat is applied to effect removal of said protecting and leaving groups whereby said colorless precursor is converted to an image dye (see the aforementioned Application Ser. No. 07/277,014, now abandoned);

h. a mixed carbonate ester of a quinophthalone dye and a tertiary alkanol containing not more than about 9 carbon atoms (see the aforementioned application Ser. No. 07/548,223)

i. a leuco dye represented by:

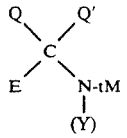

wherein:

E represents a thermally removable leaving group;

tM represents a thermally migratable acyl group;

Q, Q' and C taken together represent a dye-forming coupler moiety wherein C is the coupling carbon of said coupler moiety;

and, (Y) taken together with N represents an aromatic amino color developer, one of said Q, Q' and (Y) containing an atom selected from the atoms comprising Group 5A/Group 6A of the Periodic Table, said groups E and tM maintaining said leuco dye in a substantially colorless form until the application of heat causes said group E to be eliminated from said leuco dye and said group tM to migrate from said N atom to said Group 5A/Group 6A atom thereby forming a dye represented by:

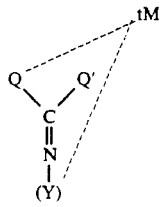

wherein said dotted lines indicate that said tM group is bonded to said Group 5A/Group 6A atom in one of said Q, Q' and (Y) (see the aforementioned copending application Ser. No. 07/696,151.

Of these color-forming compounds, it has been found that those containing a methylamino group, especially an N-phenyl-N-methylamino group wherein the phenyl group carries an electron-withdrawing substituent are particularly liable to photocoloration and hence this invention is especially useful in imaging media containing these color-forming compounds. One specific group of color-forming compounds with which this invention is especially useful are those of the formula:

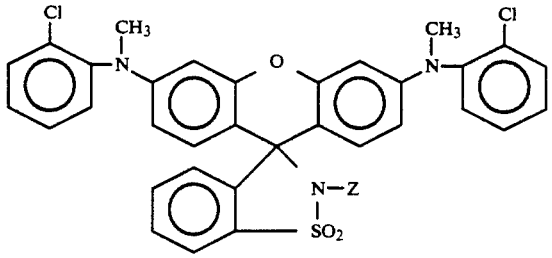

wherein Z is a substituted phenyl group; two preferred color-forming compounds of this group are:

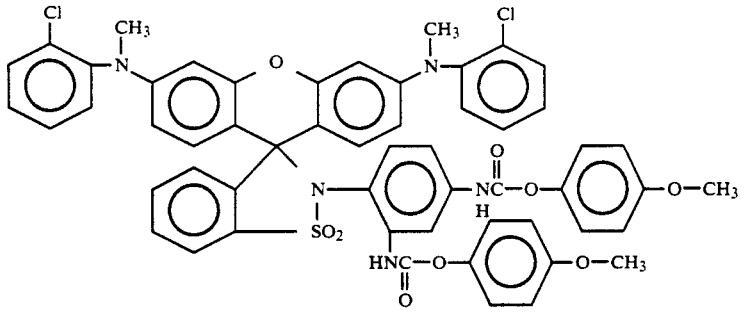

or:

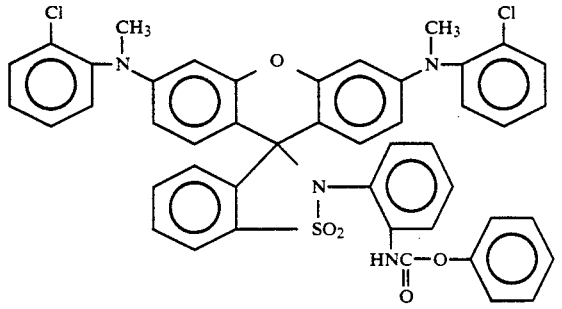

hereinafter referred to as "Leuco Dye D".

It also appears that the color-forming compounds defined in paragraph g. above and described and claimed in the aforementioned application Ser. No. 07/548,223, and especially the compound of the formula:

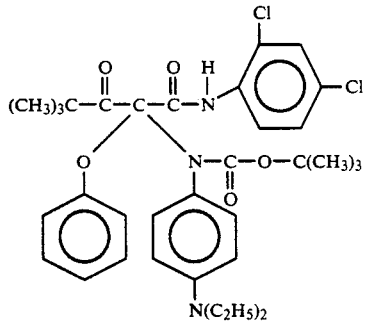

(hereinafter referred to as "Leuco Dye A") may be highly susceptible to photocoloration, and hence that the present invention may also be especially useful in imaging media containing these compounds.

Desirably, the imaging media of the present invention are provided with an ultraviolet absorbing layer. Furthermore, imaging media of the present invention intended for the production of transparencies are desirably provided with a bubble-suppressant layer as described in the aforementioned application Ser. No. 07/695,641. Thus, such a medium intended for the production of transparancies desirably comprises a substantially transparent support having a thickness of at least about 20 μm and disposed on one side of the color-forming layer; and a bubble-suppressant layer having a thickness of at least about 10 μm disposed on the opposed side of the color-forming layer, such that, upon imagewise increase in the temperature of the color-forming layer above the color-forming temperature for the color-forming time, in heated regions the color-forming layer undergoes its change of color but remains essentially free from bubbles.

In such a medium, the bubble-suppressant layer desirably has a thickness of at least about 20 μm.

Except for the presence of the hindered amine light stabilizer or nitrone, the various layers of the imaging medium of the present invention, and the techniques used for forming and exposing the medium, can be those used in the aforementioned U.S. Pat. Nos. 4,602,263; 4,720,449; 4,720,450; 4,745,046; 4,826,976; and 4,960,901, the disclosures of which are herein incorporated by reference. Thus, in carrying out the imaging method of the present invention, heat may be applied or induced imagewise in a variety of ways. Preferably, selective heating is produced in the color-forming layer itself by the conversion of electromagnetic radiation into heat, and preferably the light source is a laser beam emitting source such as a gas laser or semiconductor laser diode. The use of a laser is not only well suited for recording in a scanning mode but by utilizing a highly concentrated beam, radiant energy can be concentrated in a small area so that it is possible to record at high speed and high resolution. Also, it is a convenient way to record data as a heat pattern in response to transmitted signals, such as digitized information, and a convenient way of preparing multicolor images by employing a plurality of laser sources that emit at differing wavelengths.

Most of the aforementioned preferred leuco dyes do not absorb strongly in the infra-red. Since, at present, imaging processes are preferably carried out using an infra-red laser, in a preferred embodiment, the heat-sensitive element contains an infra-red absorbing substance for converting infra-red radiation into heat, which is transferred to the leuco dye to initiate the color-forming reaction and effect the change in the absorption characteristics of the leuco dye from colorless to colored. Obviously, the infra-red absorber should be in heat-conductive relationship with the leuco dye, for example, in the same layer as the leuco dye or in an adjacent layer. Though an inorganic compound may be employed, the infra-red absorber preferably is an organic compound, such as a cyanine, merocyanine, squarylium, thiopyrylium or benzpyrylium dye, and preferably, is substantially non-absorbing in the visible region of the electromagnetic spectrum so that it will not contribute any substantial amount of color to the $D_{min}$ areas, i.e., the highlight areas of the image. The light absorbed by the respective infra-red absorbers is converted into heat and the heat initiates the reaction to effect the formation of the colored materials in the color-forming layers.

In the production of such multi-color images, the infra-red absorbers are desirably selected such that they absorb radiation at different predetermined wavelengths above 700 nm sufficiently separated so that each color-forming layer may be exposed separately and independently of the others by using infra-red radiation at the particular wavelengths selectively absorbed by the respective infra-red absorbers. As an illustration, the color-forming layers containing yellow, magenta and cyan leuco dyes may have infra-red absorbers associated therewith that absorb radiation at 760 nm, 820 nm and 880 nm, respectively, and may be addressed by laser sources, for example, infra-red laser diodes emitting at these respective wavelengths so that the three color-forming layers can be exposed independently of one another. While each layer may be exposed in a separate scan, it is usually preferred to expose all of the color-forming layers simultaneously in a single scan using multiple laser sources of the appropriate wavelengths. Instead of using superimposed imaging layers, the leuco dyes and associated infra-red absorbers may be arranged in an array of side-by-side dots or stripes in a single recording layer.

Where imagewise heating is induced by converting light to heat as in the embodiments described above, the imaging medium may be heated prior to or during exposure. This may be achieved using a heating platen or heated drum or by employing an additional laser source or other appropriate means for heating the medium while it is being exposed.

The imaging medium of the present invention may comprise additional layers, for example, a subbing layer to improve adhesion to a support, interlayers for thermally insulating the color-forming layers from each other, diffusion-reducing layers as described and claimed in the aforementioned application Ser. No. 07/696,196, or other auxiliary layers. To give good protection against ultra-violet radiation, ultra-violet screening layers are desirably provided on both sides of the color-forming layer(s); conveniently, one of the ultra-violet screening layers is provided by using as the support a polymer film containing an ultra-violet absorber, and such absorber-containing films are available commercially.

The leuco dyes are selected to give the desired color or combination of colors, and for multicolor images, the compounds selected may comprise the subtractive primaries yellow, magenta and cyan or other combinations of colors, which combinations may additionally include black. The leuco dyes generally are selected to give the subtractive colors cyan, magenta and yellow, as commonly employed in photographic processes to provide full natural color.

Usually the or each color-forming layer contains a binder and is formed by combining the leuco dye, the infra-red absorber and the binder in a common solvent, applying a layer of the coating composition to the support and then drying. Rather than a solution coating, the layer may be applied as a dispersion or an emulsion. The coating composition also may contain dispersing agents, plasticizers, defoaming agents and coating aids. In forming the color-forming layer(s) and the interlayers or other layers, temperatures should be maintained below levels that will cause the color-forming reaction to occur rapidly so that the leuco dyes will not be prematurely colored or bleached.

Examples of binders that may be used include poly(vinyl alcohol), poly(vinyl pyrrolidone), methyl cellulose, cellulose acetate butyrate, styrene-acrylonitrile copolymers, copolymers of styrene and butadiene, poly(methyl methacrylate), copolymers of methyl and ethyl acrylate, poly(vinyl acetate), poly(vinyl butyral), polyurethane, polycarbonate and poly(vinyl chloride). It will be appreciated that the binder selected should not have any adverse effect on the leuco dye incorporated therein and may be selected to have a beneficial effect. Also, the binder should be substantially heat-stable at the temperatures encountered during image formation and it should be transparent so that it does not interfere with viewing of the color image. Where electromagnetic radiation is employed to induce imagewise heating, the binder also should transmit the light intended to initiate image formation.

A preferred embodiment of the invention will now be described, though by way of illustration only, with reference to the accompanying drawing, which is a schematic cross-section through an imaging medium of the present invention. The thicknesses of the various layers shown in the drawing are not to scale.

The imaging medium (generally designated 10) shown in the drawing is intended for use in the production of transparencies and comprises a substantially transparent support 12 formed of 4 mil (101 μm) poly(ethylene terephthalate) (PET) film incorporating an ultra-violet absorber. Appropriate PET films are readily available commercially, for example as P4C1A film from DuPont de Nemours., Wilmington, Del.

The imaging medium 10 also comprises a diffusion-reducing subcoat 14 approximately 1 μm thick formed from a 10:1 w/w mixture of a water-dispersible styrene acrylic polymer (Joncryl 538 sold by S. C. Johnson & Son, Inc., Racine Wis. 53403) and a water-soluble acrylic polymer (Carboset 526 sold by The B. F. Goodrich Co., Akron Ohio 44313). As explained above, the presence of the minor proportion of water-soluble acrylic polymer reduces the tendency for the layer 14 to crack during the coating process. The diffusion-reducing subcoat 14, which has a glass transition temperature of approximately 55° C., and serves the function of a conventional subcoat, namely increasing the adhesion of the color-forming layer 16 (described in detail below) to the support 12. The subcoat 14 also serves to reduce or eliminate migration of colored material from the color-forming layer 16 after imaging; as noted above, if a conventional subcoat were employed in place of the diffusion-reducing subcoat 14, diffusion of the colored material from the layer 16 into the subcoat after imaging might cause loss of sharpness of the image. The subcoat 14 is coated onto the support 12 from an aqueous medium containing the water-dispersible and water-soluble polymers.

A yellow color-forming layer 16 is in contact with the diffusion-reducing subcoat 14. This color-forming layer 16 is approximately 5 μm thick and comprises approximately 47.5 parts by weight of the aforementioned Leuco Dye A, 1.6 parts by weight of an infra-red absorber of the formula:

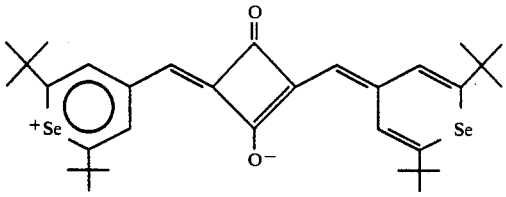

(which may be prepared by a process analogous to that described in U.S. Pat. No. 4,508,811 using the 2,6-bis(1,1-dimethylethyl)-4-methylselenopyrylium salts described in the aforementioned application Ser. No. 07/696,222, 3.3 parts by weight of a hindered amine stabilizer (HALS-63, sold by Fairmount Chemical Co., 117 Blanchard Street, Newark N.J. 07105), and 47.5 parts by weight of a poly(methyl methacrylate) binder (Elvacite 2021, sold by DuPont de Nemours, Wilmington, Del.; this material is stated by the manufacturer to be a methyl methacrylate/ethyl acrylate copolymer, but its glass transition temperature approximates that of poly(methyl methacrylate)). This binder has a glass transition temperature of approximately 110° C. The color-forming layer 16 is applied by coating from a mixture of heptanes and methyl ethyl ketone.

Superposed on the yellow color-forming layer 16 is a diffusion-reducing layer 18, which, like the first diffusion-reducing layer 14, serves to prevent migration of colored material from the yellow color-forming layer 16 on storage after imaging. The diffusion-reducing layer 18, which is approximately 2 μm thick, is formed of a water-dispersible styrene acrylic polymer (Joncryl 138 sold by S.C. Johnson & Son, Inc., Racine, Wis. 53403), and is coated from an aqueous dispersion. This layer has a glass transition temperature of approximately 60° C.

The next layer of the imaging medium 10 is a solvent-resistant interlayer 20 approximately 4.6 μm and composed of a major proportion of partially cross-linked polyurethane (NeoRez XR-9637 polyurethane sold by ICI Resins US, Wilmington, Mass.) and a minor proportion of poly(vinyl alcohol) (Airvol 540, sold by Air Products and Chemicals, Inc., Allentown Pa. 18195). This solvent-resistant interlayer 20 is coated from an aqueous dispersion. The interlayer 20 not only helps to thermally insulate the color-forming layers 14 and 22 (described below) from one another during imaging, but also prevents disruption and/or damage to the yellow color-forming layer 16 and the diffusion-reducing layer 18 during coating of the magenta color-forming layer 22. Since the yellow color-forming layer 16 and the magenta color-forming layer 22 are both coated from organic solutions, if a solvent-resistant interlayer were not provided on the layer 16 before the layer 22 was coated, the organic solvent used to coat the layer 22 may disrupt, damage or extract leuco dye or infra-red absorber from the layer 16. Provision of the solvent-resistant interlayer 20, which is not dissolved by and does not swell in the organic solvent used to coat the layer 22, serves to prevent disruption of or damage to the layer 16 as the layer 22 is coated. Furthermore, the solvent-resistant interlayer 20 serves to prevent the magenta leuco dye from the layer 22 sinking into the diffusion-reducing layer 18 and the yellow color-forming layer 16 as the layer 22 is being coated.

Superposed on the solvent-resistant interlayer 20 is the magenta color-forming layer 22, which is approximately 3 μm thick and comprises approximately 47.25 parts by weight of a leuco dye of the formula:

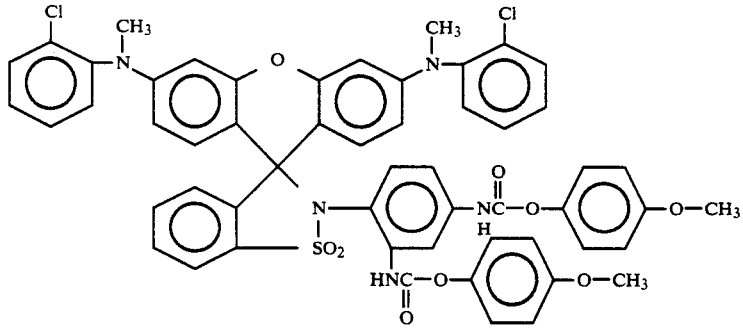

(hereinafter referred to as "Leuco Dye B"; this leuco dye may be prepared by the methods described in the aforementioned U.S. Pat. Nos. 4,720,449 and 4,960,901), 1.62 parts by weight of an infra-red absorber of the formula:

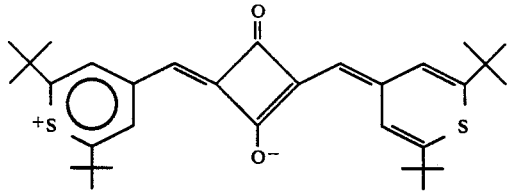

(see the aforementioned U.S. Pat. 4,508,811), 3.6 parts by weight of a hindered amine stabilizer (HALS-63), 0.27 parts by weight of a wetting agent, and 47.25 parts by weight of a polyurethane binder (Estane 5715, supplied by The B.F. Goodrich Co., Akron Ohio 44313). The color-forming layer 22 is applied by coating from a cyclohexanone/methyl ethyl ketone On the color-forming layer 22 is coated a second solvent-resistant interlayer 24 which is formed from the same material, and coated in the same manner as, the solvent-resistant interlayer 20.

Superposed on the second solvent-resistant interlayer 24 is a cyan color-forming layer 26, which is approximately 3 μm thick and comprises approximately 49.5 parts by weight of a leuco dye of the formula:

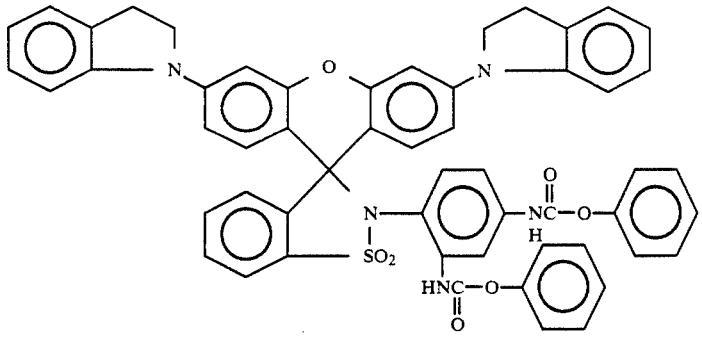

(hereinafter referred to as "Leuco Dye C"; this leuco dye may be prepared by the methods described in the aforementioned U.S. Pat. Nos. 4,720,449 and 4,960,901), 0.7 parts by weight of an infra-red absorber of the formula:

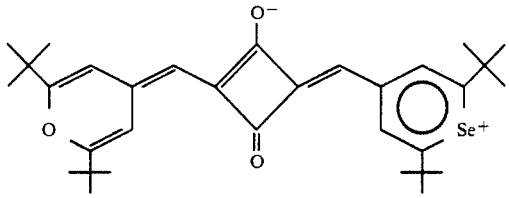

(which may be prepared as described in the aforementioned copending application Ser. No. 07/696/222, 0.2 parts of a wetting agent, and 49.5 parts by weight of a polyurethane binder (Estane 5715). The color-forming layer 26 is applied by coating from methyl ethyl ketone.

As already indicated, the layers 14–26 imaging medium 10 are produced by coating on to the transparent support 12. However, the remaining layers of the imaging medium 10, namely the transparent bubble-suppressant layer 32, the ultraviolet filter layer 30 and the adhesive layer 28 are not coated on to the layer 26 but rather are prepared as a separate unit and then laminated to the remaining layers of the medium.

The transparent bubble-suppressant layer 32 is a 1.75 mil (44 μm) PET film, a preferred film being that sold as ICI 505 film by ICI Americas, Inc., Wilmington, Del. As explained in more detail in the aforementioned copending application Ser. No. 07/695,641, the bubble-suppressant layer 32 prevents the formation of bubbles in the imaging medium 10 during imaging, and thus helps to ensure that the colors in the imaged medium are not affected by bubble formation.

The ultraviolet filter layer 30 serves to protect the color-forming layers 16, 22 and 26 from the effects of ambient ultraviolet radiation. It has been found that the leuco dyes are susceptible to undergoing color changes when exposed to ultraviolet radiation during storage before or after imaging; such color changes are obviously undesirable since they increase the $D_{min}$ of the image and may distort the colors therein. The ultraviolet filter layer 30 is approximately 5 μm thick and comprises approximately 83 percent by weight of a poly(-methyl methacrylate) (Elvacite 2043, sold by DuPont de Nemours, Wilmington, Mass.), 16.6 percent by weight of an ultraviolet filter (Tinuvin 328 sold by Ciba-Geigy, Ardsdale N.Y.) and 0.4 percent by weight of a wetting agent. The ultraviolet filter layer 30 is prepared by coating on to the bubble-suppressant layer 32 from a solution in methyl ethyl ketone.

The adhesive layer, which is approximately 2 μm thick, is formed of a water-dispersible styrene acrylic polymer (Joncryl 138 sold by S. C. Johnson & Son, Inc., Racine Wis. 53403) and is coated on to the ultraviolet filter layer 30 from an aqueous dispersion.

After the layers 30 and 28 have been coated on to the bubble-suppressant layer 32, the entire structure containing these three layers is laminated under heat (approximately 225° F., 107° C.) and pressure to the structure containing the layers 12–26 to form the complete imaging medium 10.

If desired, the bubble-suppressant layer 32 may be formed by coating, rather than by lamination of a preformed film on to the layers 12–26. If the bubble-suppressant layer 32 is to be formed by coating, it is convenient to incorporate an ultra-violet absorber into the bubble-suppressant layer, thereby avoiding the need for a separate ultra-violet absorber layer. Thus, in this case, the layer 28 is coated on to the layer 26 using the solvent already described, and then the bubble-suppressant layer 32 containing the ultra-violet absorber may be coated on to the layer 28 from an aqueous medium.

The imaging medium 10 may be provided with additional layers, for example an anti-abrasion layer, superposed on the bubble-suppressant layer 32.

The medium 10 is imaged by exposing it simultaneously to the beams from three infra-red lasers having wavelengths of approximately 792, 822 and 869 nm. The 869 nm beam images the yellow color-forming layer 16, the 822 nm beam images the magenta color-forming layer 22 and the 792 nm beam images the cyan color-forming layer 26. Thus, a multicolor image is formed in the imaging medium 10, and this multicolor image requires no further development steps. Furthermore, the medium 10 may be handled in normal room lighting prior to exposure, and the apparatus in which the imaging is performed need not be light-tight.

We claim:

1. An imaging medium having at least one color-forming layer comprising a thermal color-forming composition adapted to undergo a change of color upon increase in the temperature of the color-forming layer above a color-forming temperature for a color-forming time, the color-forming layer further comprising a color stabilizer selected from the group consisting of hindered amine light stabilizers and nitrones.

2. An imaging medium according to claim 1 wherein the color stabilizer comprises a hindered amine light stabilizer.

3. An imaging medium according to claim 2 wherein the hindered amine light stabilizer has a molecular weight of at least about 500.

4. An imaging medium according to claim 3 wherein the hindered amine light stabilizer comprises 4-[N-methyl-2,2,6,6-tetraalkylpiperidinyl groups and/or 4-[2,2,6,6-tetraalkylpiperidinyl] groups.

5. An imaging medium according to claim 2 in which the color-forming composition comprises a color-forming compound which undergoes a change of color upon heating above the color-forming temperature for the color-forming time, and an absorber capable of absorbing actinic radiation and thereby generating heat in the color-forming layer.

6. An imaging medium according to claim 5 wherein the color-forming layer comprises at least about 0.01 parts by weight of hindered amine light stabilizer per part by weight of the color-forming compound.

7. An imaging medium according to claim 6 wherein the color-forming layer comprises at least about 0.05 parts by weight of hindered amine light stabilizer per part by weight of the color-forming compound.

8. An imaging medium according to claim 7 wherein the color-forming compound is selected from the group consisting of:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, said unimolecular fragmentation visibly changing the appearance of the organic compound;

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to said meso carbon atom and said nitrogen atom being bound to a group with a masked acyl substituent that undergoes fragmentation upon heating to liberate the acyl group for effecting intramolecular acylation of said nitrogen atom to form a new group in the ortho position that cannot bond to the meso carbon atom, whereby said di- or triarylmethane compound is rendered colored;

c. a colored di- or triarylmethane imaging compound possessing within its di- or triarylmethane structure an aryl group substituted in the ortho position to the meso carbon atom with a thermally unstable urea moiety, said urea moiety undergoing a unimolecular fragmentation reaction upon heating to provide a new group in said ortho position that bonds to said meso carbon atom to form a ring having 5 or 6 members, whereby said di- or triarylmethane compound becomes ring-closed and rendered colorless;

d. in combination, a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting said di- or triarylmethane compound undergoes a bimolecular nucleophilic substitution reaction with said nucleophilic moiety to form a colored, ring-opened di- or triarylmethane compound;

e. a compound of the formula $$[M'(X)_q]_pD$$

wherein M' has the formula:

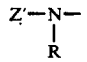

wherein R is alkyl; $—SO_2R^1$ wherein $R^1$ is alkyl; phenyl; naphthyl; or phenyl substituted with alkyl, alkoxy, halo, trifluoromethyl, cyano, nitro, carboxy, $—CONR^2R^3$ wherein $R^2$ and $R^3$ each are hydrogen or alkyl, $—CO_2R^4$ wherein $R^4$ is alkyl or phenyl, $—COR^5$ wherein $R^5$ is amino, alkyl or phenyl, $—NR^6R^7$ wherein $R^6$ and $R^7$ each are hydrogen or alkyl, $—SO_2NR^8R^9$ wherein $R^8$ and $R^9$ each are hydrogen, alkyl or benzyl; Z' has the formula:

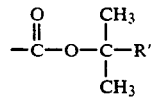

wherein R' is halomethyl or alkyl; X is —N=, $—SO_2—$ or $—CH_2—$; D taken with X and M' represents the radical of a color-shifted organic dye; q is 0 or 1; and p is a whole number of at least 1; said Z' being removed from said M' upon the application of heat to effect a visually discernible change in spectral absorption characteristics of said dye;

f. a substantially colorless di- or triarylmethane compound of the formula:

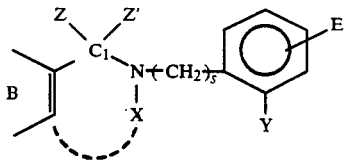

wherein ring B represents a carbocyclic aryl ring or a heterocyclic aryl ring; $C_1$ represents the meso carbon atom of said di- or triarylmethane compound; X represents —C(=O)—; $—SO_2—$ or $—CH_2—$ and completes a moiety ring-closed on said meso carbon atom, said moiety including the nitrogen atom bonded directly to said meso carbon atom; Y represents —NH—C(=O)—L, wherein L is a leaving group that departs upon thermal fragmentation to unmask —N=C=O for effecting intramolecular acylation of said nitrogen atom to open the N-containing ring and form a new group in the ortho position of ring B that cannot bond to said meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when said N-containing ring is open, and Z and Z' taken together represent the bridged moieties to complete the auxochromic system of a bridged triarylmethane dye when said N-containing ring is open;

g. a colorless precursor of a preformed image dye substituted with (a) at least one thermally removable protecting group that undergoes fragmentation from said precursor upon heating and (b) at least one leaving group that is irreversibly eliminated from said precursor upon heating, provided that neither said protecting group nor said leaving group is hydrogen, said protecting and leaving groups maintaining said precursor in its colorless form until heat is applied to effect removal of said protecting and leaving groups whereby said colorless precursor is converted to an image dye;

h. mixed carbonate ester of a quinophthalone dye and a tertiary alkanol containing not more than about 9 carbon atoms i. a leuco dye represented by:

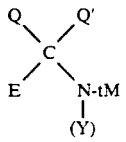

wherein:

E represents a thermally removable leaving group;

tM represents a thermally migratable acyl group;

Q, Q' and C taken together represent a dye-forming coupler moiety wherein C is the coupling carbon of said coupler moiety;

and, (Y) taken together with N represents an aromatic amino color developer, one of said Q, Q' and (Y) containing an atom selected from the atoms comprising Group 5A/-Group 6A of the Periodic Table, said groups E and tM maintaining said leuco dye in a substantially colorless form until the application of heat causes said group E to be eliminated from said leuco dye and said group tM to migrate from said N atom to said Group 5A/Group 6A atom thereby forming a dye represented by:

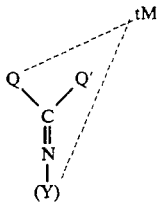

wherein said dotted lines indicate that said tM group is bonded to said Group 5A/Group 6A atom in one of said Q, Q' and (Y).

9. An imaging medium according to claim 8 wherein the color-forming compound comprises a methylamino group.

10. An imaging medium according to claim 9 wherein the color-forming compound comprises an N-phenyl-N-methylamino group wherein the phenyl group carries an electron-withdrawing substituent.

11. An imaging medium according to claim 10 wherein the color-forming compound comprises:

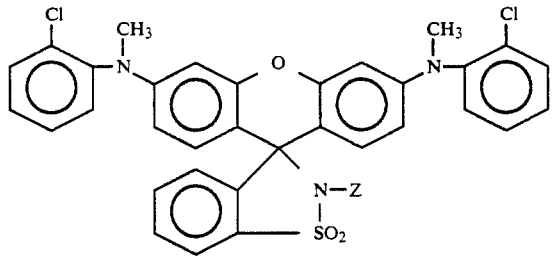

wherein Z is a substituted phenyl group.

12. An imaging medium according to claim 11 wherein the color-forming compound comprises:

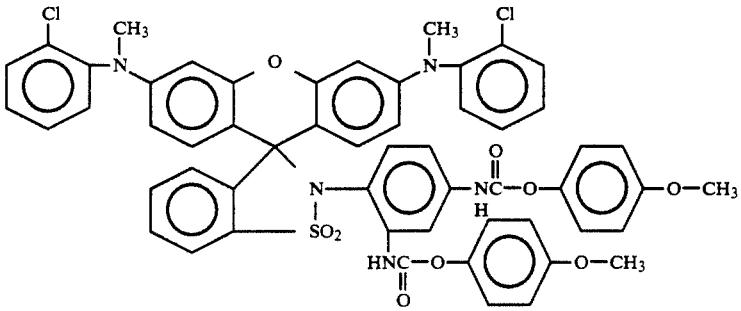

or:

-continued

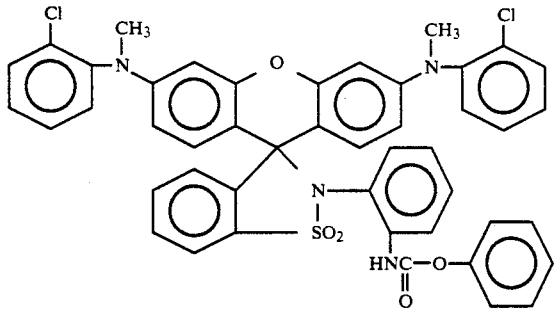

13. An imaging medium according to claim 1 further comprising an ultraviolet absorbing layer disposed on one side of the color-forming layer for absorbing ultraviolet radiation incident upon said one side of the color-forming layer.

14. An imaging medium capable of being imaged to form a transparency and comprising:

at least one color-forming layer comprising a thermal color-forming composition adapted to undergo a change of color upon increase in the temperature of the color-forming layer above a color-forming temperature for a color-forming time, the color-forming layer further comprising a color stabilizer selected from the group consisting of hindered amine light stabilizers and nitrones a substantially transparent support having a thickness of at least about 20 μm and disposed on one side of the at least one color-forming layer; and a bubble-suppressant layer having a thickness of at least about 10 μm disposed on the opposed side of the at least one color-forming layer, such that, upon imagewise increase in the temperature of the or each color-forming layer above the color-forming temperature for the color-forming time, in heated regions the color-forming layer undergoes its change of color but remains essentially free from bubbles.

15. An imaging medium according to claim 14 in which the bubble-suppressant layer has a thickness of at least about 20 μm.

16. A process for forming an image, the process comprising:

providing an imaging medium comprising a color-forming layer comprising a thermal color-forming composition adapted to undergo a change of color upon increase in the temperature of the color-forming layer above a color-forming temperature for a color-forming time, the color-forming layer further comprising a color stabilizer selected from the group consisting of hindered amine light stabilizers and nitrones;

imagewise heating the color-forming layer above the color-forming temperature for the color-forming time, thereby causing the color-forming composition to undergo the change of color in heated regions and thereby form an image.

17. A process according to claim 16 wherein the color stabilizer comprises a hindered amine light stabilizer.

18. A process according to claim 17 wherein the color-forming layer comprises at least about 0.01 parts by weight of hindered amine light stabilizer per part by weight of the color-forming compound.

19. A process according to claim 17 wherein the layer comprises a color-forming compound selected from the group consisting of:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, said unimolecular fragmentation visibly changing the appearance of the organic compound;

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to said meso carbon atom and said nitrogen atom being bound to a group with a masked acyl substituent that undergoes fragmentation upon heating to liberate the acyl group for effecting intramolecular acylation of said nitrogen atom to form a new group in the ortho position that cannot bond to the meso carbon atom, whereby said di- or triarylmethane compound is rendered colored;

c. a colored di- or triarylmethane imaging compound possessing within its di- or triarylmethane structure an aryl group substituted in the ortho position to the meso carbon atom with a thermally unstable urea moiety, said urea moiety undergoing a unimolecular fragmentation reaction upon heating to provide a new group in said ortho position that bonds to said meso carbon atom to form a ring having 5 or 6 members, whereby said di- or triarylmethane compound becomes ring-closed and rendered colorless;

d. in combination, a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting said di- or triarylmethane compound undergoes a bimolecular nucleophilic substitution reaction with said nucleophilic moiety to form a colored, ring-opened di- or triarylmethane compound;

e. a compound of the formula $$[M'(-X)_{\overline{q}}]_{\overline{p}}D$$

wherein M' has the formula:

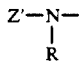

wherein R is alkyl; $—SO_2R^1$ wherein $R^1$ is alkyl; phenyl; naphthyl; or phenyl substituted with alkyl, alkoxy, halo, trifluoromethyl, cyano, nitro, carboxy, $—CONR^2R^3$ wherein $R^2$ and $R^3$ each are hydrogen or alkyl, $—CO_2R^4$ wherein $R^4$ is alkyl or phenyl, $—COR^5$ wherein $R^5$ is amino, alkyl or phenyl, $—NR^6R^7$ wherein $R^6$ and $R^7$ each are hydrogen or alkyl, $—SO_2NR^8R^9$ wherein $R^8$ and $R^9$ each are hydrogen, alkyl or benzyl; Z' has the formula:

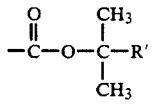

wherein R' is halomethyl or alkyl; X is —N=, $—SO_2—$ or $—CH_2—$; D taken with X and M' represents the radical of a color-shifted organic dye; q is 0 or 1; and p is a whole number of at least 1; said Z' being removed from said M' upon the application of heat to effect a visually discernible change in spectral absorption characteristics of said dye;

f. a substantially colorless di- or triarylmethane compound of the formula:

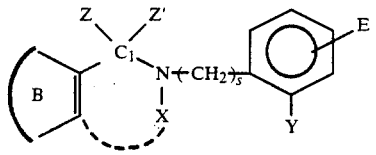

wherein ring B represents a carbocyclic aryl ring or a heterocyclic aryl ring; $C_1$ represents the meso carbon atom of said di- or triarylmethane compound; X represents —C(=O)—; $—SO_2—$ or $—CH_2—$ and completes a moiety ring-closed on said meso carbon atom, said moiety including the nitrogen atom bonded directly to said meso carbon atom; Y represents —NH—C(=O)—L, wherein L is a leaving group that departs upon thermal fragmentation to unmask —N=C=O for effecting intramolecular acylation of said nitrogen atom to open the N-containing ring and form a new group in the ortho position of ring B that cannot bond to said meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when said N-containing ring is open, and Z and Z' taken together represent the bridged moieties to complete the auxochromic system of a bridged triarylmethane dye when said N-containing ring is open;

g. a colorless precursor of a preformed image dye substituted with (a) at least one thermally removable protecting group that undergoes fragmentation from said precursor upon heating and (b) at least one leaving group that is irreversibly eliminated from said precursor upon heating, provided that neither said protecting group nor said leaving group is hydrogen, said protecting and leaving groups maintaining said precursor in its colorless form until heat is applied to effect removal of said protecting and leaving groups whereby said colorless precursor is converted to an image dye;

h. mixed carbonate ester of a quinophthalone dye and a tertiary alkanol containing not more than about 9 carbon atoms i. a leuco dye represented by:

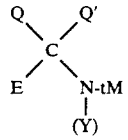

wherein:

E represents a thermally removable leaving group;

tM represents a thermally migratable acyl group;

Q, Q' and C taken together represent a dye-forming coupler moiety wherein C is the coupling carbon of said coupler moiety;

and, (Y) taken together with N represents an aromatic amino color developer, one of said Q, Q' and (Y) containing an atom selected from the atoms comprising Group 5A/-Group 6A of the Periodic Table, said groups E and tM maintaining said leuco dye in a substantially colorless form until the application of heat causes said group E to be eliminated from said leuco dye and said group tM to migrate from said N atom to said Group 5A/Group 6A atom thereby forming a dye represented by:

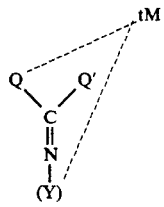

wherein said dotted lines indicate that said tM group is bonded to said Group 5A/Group 6A atom in one of said Q, Q' and (Y).

* * * * *